United States Patent [19]

Dubbink et al.

[11] 4,295,683

[45] Oct. 20, 1981

[54] ORTHOPEDIC CHAIR

[76] Inventors: David T. Dubbink, 1339 N. Sultana, Ontario, Calif. 91764; Lynda L. Vogler, 8855 Mustang Ave., Alta Loma, Calif. 91701

[21] Appl. No.: 56,532

[22] Filed: Jul. 11, 1979

[51] Int. Cl.[3] ..... A47C 5/06

[52] U.S. Cl. ..... 297/377; 297/423; 297/457; 297/458; 297/396; 4/523

[58] Field of Search ..... 4/185 B, 185 HB, 185 S, 4/185 R; 5/82 R, 89; 297/19, 21, 22, 182, 313, 328, 355, 396, 403, 423, 454, 457, 458, 459, 466

[56] References Cited

U.S. PATENT DOCUMENTS

| | | | |
|---|---|---|---|
| 1,252,751 | 1/1918 | Weatherford | 297/457 X |
| 2,495,482 | 1/1950 | Rogatz | 4/185 B X |
| 2,600,944 | 6/1952 | Sam | 297/423 |
| 2,611,363 | 9/1952 | Peters | 297/466 X |
| 2,697,480 | 12/1954 | DuBois et al. | 4/185 B X |
| 2,702,074 | 2/1955 | Vincent | 297/396 X |
| 2,728,376 | 12/1955 | Halde | 297/458 X |
| 2,836,833 | 6/1958 | Carlson | 297/458 |
| 2,856,986 | 10/1958 | O'Leary | 297/439 |
| 2,970,638 | 2/1961 | Halter | 297/458 X |
| 3,011,826 | 12/1961 | Bowring et al. | 297/458 X |
| 3,890,004 | 6/1975 | Rail | 297/458 X |
| 3,902,737 | 9/1975 | Berger et al. | 297/423 |
| 4,072,345 | 2/1978 | Matsuda | 297/452 X |
| 4,084,849 | 4/1978 | Ishida et al. | 297/377 X |

FOREIGN PATENT DOCUMENTS

| | | | |
|---|---|---|---|
| 515173 | 11/1952 | Belgium | 5/82 |
| 1073820 | 6/1967 | United Kingdom | 297/458 |

*Primary Examiner*—Francis K. Zugel

*Attorney, Agent, or Firm*—Poms, Smith, Lande & Rose

[57] ABSTRACT

An orthopedic chair particularly suited for bathing handicapped individuals. A sling-type body is supported by an adjustable frame. In the portion supporting the legs, two U-shaped rigid members support and divide the sling in two U-shaped slings to individually support and separate the legs. The upper portion adjacent the head is releasable to allow the head to be unsupported and provide access for washing the head and hair. By reclining the chair and releasing the head supporting portion, the head and hair of the individual are placed in close proximity to the water of a bathtub wherein the chair is placed. Additionally, the structure provides a grip for the individual when in such a reclining position.

2 Claims, 21 Drawing Figures

PRIOR ART

1. SITTING UP POSITION
2. HAIR WASHING POSITION
3. FLAT POSITION STORAGE

ORTHOPEDIC CHAIR

BACKGROUND OF THE INVENTION

The present invention relates to sling-type chairs and, more particularly, to such chairs as adapted to meet the needs of handicapped individuals.

Sling-type chairs have been known for a good number of years. Prior to the advent of contemporary tubular aluminum lawn furniture with plastic webbing, canvas slings adjustably supported by a wooden frame having a horizontal bar at either end was a common item of outdoor furniture.

A basic sling-type assembly such as that shown in FIG. 1 has found continued acceptance for use with the handicapped. In particular, children affected with various handicaps are maintained securely and avoid injury when cradled in such a chair of fabric, netting, or the like. Moreover, such chairs are lightweight and easily cleaned. While many variations are available, the prior art chairs available generally are such as that indicated generally as 10 in FIG. 1. Chair 10 comprises a unitary metal frame 12 adapted to sit on a horizontal surface 14 as with the suction cups 16. The frame 12 includes a horizontal bottom member 18 and a horizontal top member 20 disposed above the bottom member 18. For added rigidity, a pair of side members 22 are disposed between opposite ends of the bottom member 18 and top member 20. As can be seen, bottom member 18, top member 20, and side members 22 bound a generally rectangular area supported by the balance of frame 12 at about a 30-degree angle with the horizontal. A fabric body 24 is connected between the top and bottom members 18, 20 and side members 22 as shown. Fabric body 24 is disposed loosely to form a sling "pocket" wherein the individual can be safely placed.

For example, an individual 26 is shown in partially cut-away simplified view in FIG. 2 in a chair 10 such as that of FIG. 1 being disposed within a bathtub 28 containing water 30.

As can be seen, the chair 10 of FIGS. 1 and 2 has several drawbacks, particularly when employed in bathing the individual 26 as shown in FIG. 2. For example, bottom member 18 pushes on the back of the knees of the individual 26, which can be detrimental to handicapped individuals with poor circulation. Moreover, many handicapped individuals, because of their particular handicap, tend to contort their legs such that washing between the legs and in the genital area is quite difficult. Moreover, as can be seen, the fabric body 24 is disposed between the head and hair of the individual 26 and the water 30 in the bathtub 28. Consequently, washing the hair of the individual 26 is particularly difficult.

Moreover, as can be seen, while simple and easy to construct, a unitary construction such as that of the chair 10 is difficult to store.

Wherefore, it is the object of the present invention to provide an orthopedic chair for handicapped individuals which is foldable for storing, adjustable between positions, provides a leg separation and holding function, and provides means for easily washing the hair of an individual in the chair.

SUMMARY

The foregoing objectives have been met by the present invention which comprises an orthopedic chair comprising a frame assembly having a pair of spaced side members, a bottom member connected between said side members on one of the ends thereof, and a top member connected in parallel to said bottom member between said side members on the other ends thereof, said frame assembly further including support means for supporting said frame assembly and for maintaining said top and bottom members horizontal with said top member above said bottom member when said frame assembly is placed on a substantially horizontal surface; and, a body portion of flexible sheeting connected to said frame assembly between said bottom member and said side members to a point close adjacent said top member to form a sling chair wherein the individual can sit supported from a point at about the knees up to and including the individual's head, said body portion including means for releasing a portion of said connection of said body portion between said side members adjacent said top portion to not support the individual's head and provide access for washing the individual's head and hair.

To additionally meet the objectives, said bottom member comprises two upward-facing U-shaped sections; and, said body portion is attached to said bottom member to form U-shaped slings in respective ones of said U-shaped sections whereby the legs of the individual when placed in respective ones of said slings are supported and separated.

Moreover, said support means includes means for adjustably positioning the relative horizontal positions of said top and bottom members whereby an individual in the chair can be reclined at various positions.

In the preferred embodiment, said releasing means of said body portion comprises a pair of zippers extending from an edge of said body portion adjacent said top member toward said bottom member being disposed to have respective ones of said zippers on opposite sides of the head of an individual in the seat.

DESCRIPTION OF THE PREFERRED EMBODIMENT

Figure 4:
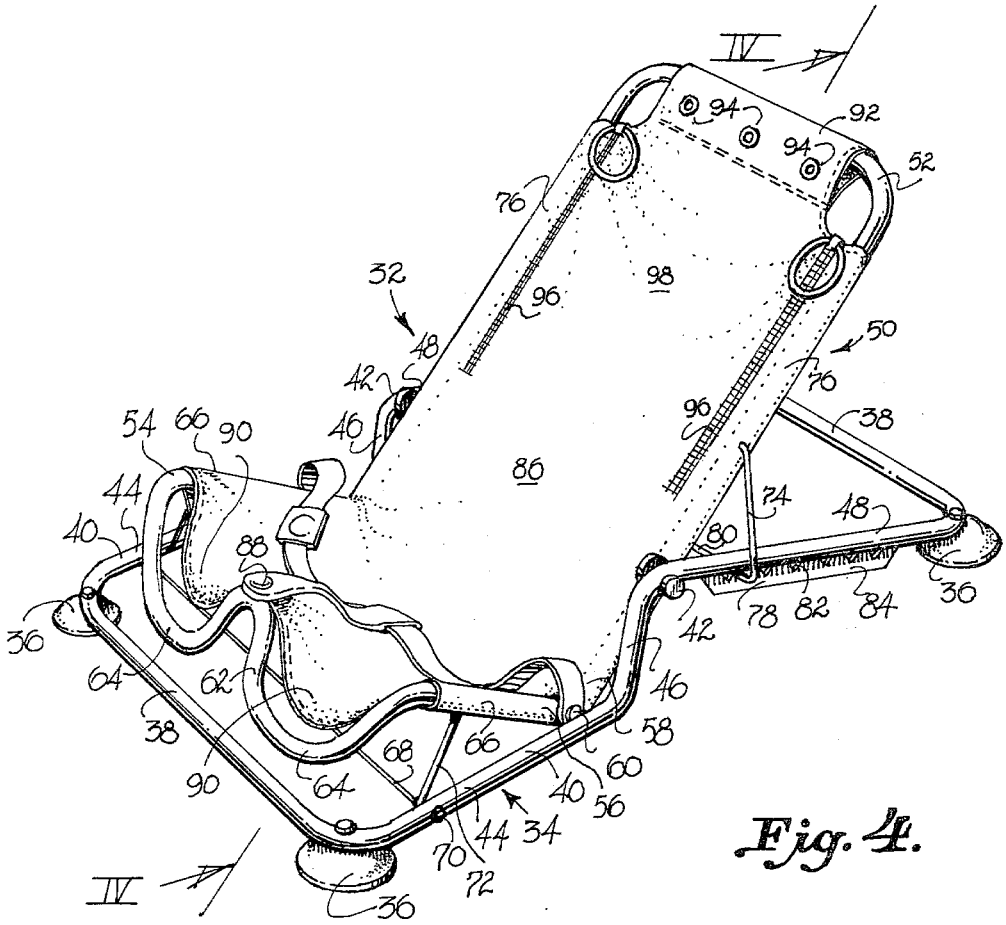
FIG. 4 is a perspective view of the preferred embodiment of the chair of the present invention.

Referring now to FIG. 4, the chair of the present invention according to its preferred embodiment is shown in perspective and indicated, generally, as 32. Chair 32 has a generally rectangular base 34 made of tubular material and having the four corners thereof in a common plane. To prevent slipping, particularly in bathtub usage, the rectangular base 34 has suction cups 36 at the corners thereof. Rectangular base 34 has two end pieces 38 and two side pieces 40. The two side pieces have pivot points 42 disposed approximately half way between the end pieces 38 and at a point above the plane containing the corners of rectangular base 34. The pivot points 42 could be so raised by several methods. In the preferred embodiment, however, the side pieces 40 are configured as shown with bottom portion 44 disposed to be substantially horizontal, middle portion 46 being bent upwardly toward the pivot point 42 at almost a 90° angle, and thereafter top portion 48 angling from the pivot point 42 to the end pieces 38.

Disposed within the rectangular base 34, is the seat portion, generally indicated as 50. Seat portion 50 has an upper portion 52 which is of tubular material being a rectangular downward facing U-shape and which is rotatably attached to the pivot point 42 on either side at points approximately one-third of the way up from the open end of the "U."

Seat portion 50 also has a bottom portion 54, being a rectangular upward facing U-shaped section having the ends 56 thereof pivotally attached to the ends 58 of the upper portion 52 at pivot points 60.

To provide the leg support and separation function (adductor), the closed end 62 of the bottom portion 54 defines two upward facing U-shaped segments 64 at right angles to the side pieces 66 of bottom portion 54.

To provide the desired adjustability features, seat portion 50 of chair 32 is further supported at two points. First, a rod 68 is rotatably disposed in holes 70 disposed in bottom portion 44 adjacent the bottom end piece 38. Vertical rods 72 are connected to rod 68 adjacent bottom portion 44 on each side at one end and are pivotally attached to side pieces 66 on the opposite end. Additionally, second vertical rods 74 are pivotally connected to the side pieces 76 of upper portion 52 on one end at a point approximately one-third of the way from pivot point 42. The opposite ends of second vertical rods 74 are connected to releasable adjusting means carried by top portions 48. In the preferred embodiment, the adjusting means comprises toothed members 78 having rod 80 disposed to move through slot 82 into engagement with notches 84 to effect the adjustment. Numerous other adjusting devices well-known in the art could be used, of course.

Figure 1:
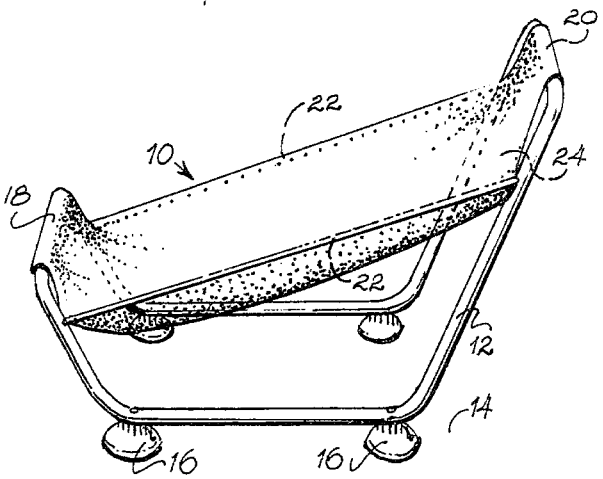
Fig. 1. PRIOR ART
FIG. 1 is an perspective view of a sling chair according to the prior art.
Figure 2:
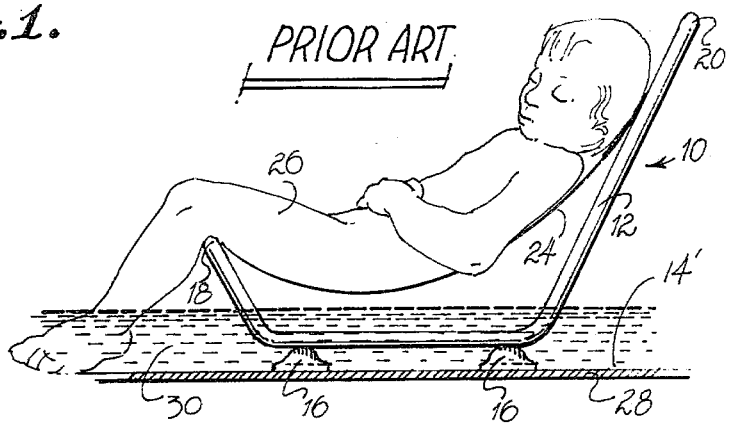
FIG. 2 is a partially cut-away simplified drawing of the chair of FIG. 1 shown holding an individual in a bathtub.
Figure 3:
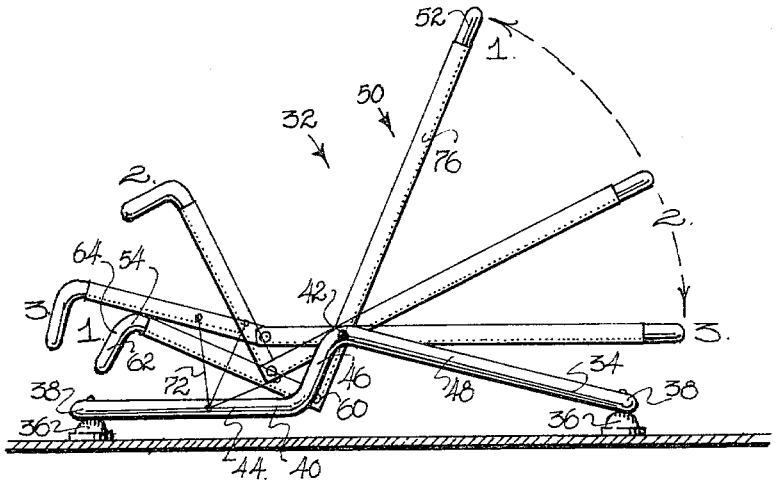
FIG. 3 is a side view of the chair of FIG. 4 in simplified form showing various positions thereof.

Referring briefly to FIG. 3, the adjustability provided by the foregoing construction can be seen. Chair 32 has three major positions. Depending on the amount of adjustment provided, various intermediate positions can be achieved. In the position labeled "1," a sitting-up position of about 60° to the horizontal is provided. In the position labeled "2," an occupant of the chair is reclined at about 30° to the horizontal with the legs lifted and separated for ease of cleaning and with the upper torso and head reclined backward for ease of washing in a manner to be described more fully hereinafter. In the position labeled "3," the chair is in a virtually flat position to allow ease of storage. Note that in the entire range between sitting and reclining the construction maintains about 90° between the seat and back portions. This is particularly beneficial in bathing handicapped individuals.

Returning once again to FIG. 4, chair 32 is completed by the addition of a fabric sling portion 86 disposed within seat portion 50 as shown. Fabric sling portion 86 is connected to the side pieces 76 and 66 as by wrapping thereabout and affixing with screws, rivets, or the like. Fabric sling portion 86 is loosely draped between side pieces 66 and attached at point 88 between the two U-shaped segments 64 only. Thus, two U-shaped slings 90 are formed to support and separate the legs of an individual in the seat 32.

Figure 5:
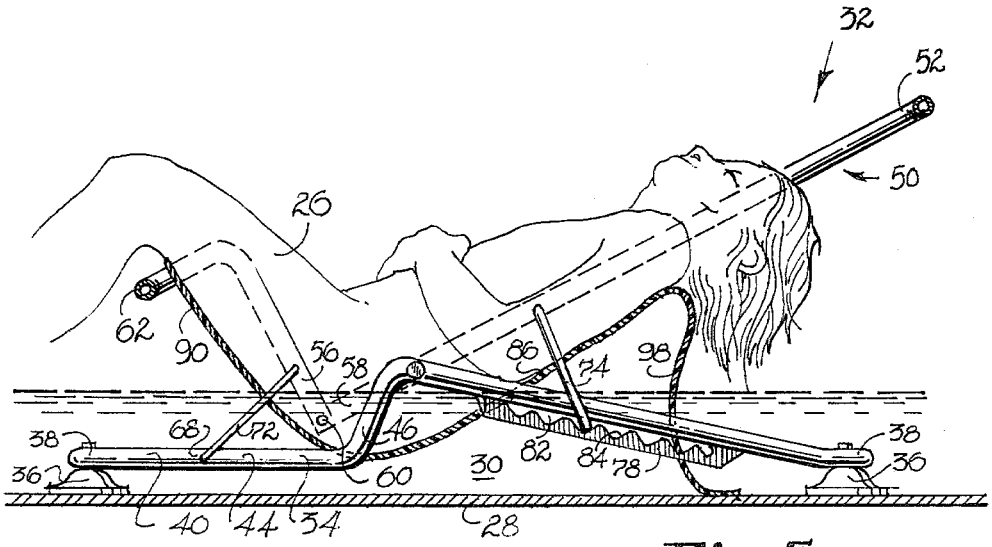
FIG. 5 is a partially cut-away side view of the chair of FIG. 4 shown disposed in a bathtub holding an individual having their hair washed.

The fabric sling portion 86 has a loop 92 which passes over the end of the upper portion 52 to be releasably fastened with snaps 94 or other similar releasable closures. Additionally, a pair of zippers 96 extend from the edge of fabric sling portion 86 adjacent loop 92 downward toward pivot points 42 adjacent each of the side pieces 76. Thus, with an individual sitting in the seat 32, the zippers 96 are disposed on either side of the head of the individual. By releasing snap 94 and lowering zippers 96, a flap 98 in fabric sling portion 86 is created which drops downward to expose the head and hair of the individual as shown in FIG. 5. It has been found in chairs built and tested with children that the children find security in reaching above their head and grasping the end of upper portion 52 with their hands when their head, and sometimes, additionally, the upper torso, is unsupported.

Figure 6:
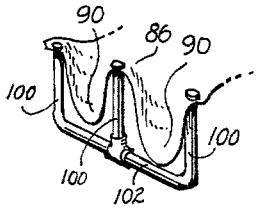
FIG. 6 is a drawing showing a first alternate construction for the leg separation and support portion of the chair of the present invention.

While the description hereinbefore is of the chair of the present invention in its preferred embodiment, many variations can be made within the spirit and scope of the invention. For example, in FIG. 6 the U-shaped slings 90 are formed by suspending the fabric sling portion 86 from three posts 100 rising vertically from a horizontal member 102.

Figure 7:
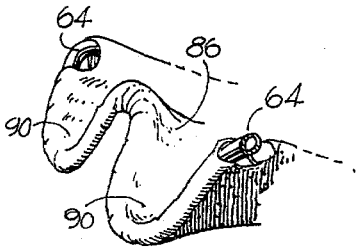
FIG. 7 is a drawing showing a second alternate construction for the leg separation and support portion of the chair of the present invention.

In FIG. 7, the U-shaped slings 90 are formed by wrapping the fabric sling portion 86 about the contours of the two U-shaped segments 64.

Figure 8:
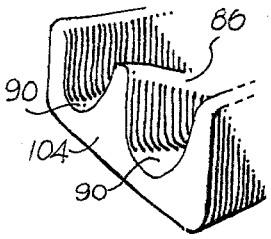
FIG. 8 is a drawing showing a third alternate construction for the leg separation and support portion of the chair of the present invention.

In FIG. 8, the U-shaped slings 90 are formed of a unitary plastic member 104 to which the sling portion 86 is molded, attached, or draped over.

Figure 9:
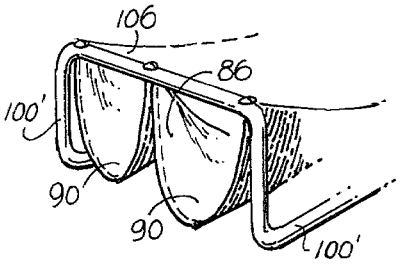
FIG. 9 is a drawing showing a fourth alternate construction for the leg separation and support portion of the chair of the present invention.

In FIG. 9, the U-shaped slings 90 are formed by suspending the fabric sling portion 86 from a cross-member 106 supported on posts 100′ at the two ends and the middle of cross-member 106. This particular arrangement has the advantage that cross-member 106 also serves as a restraint for the legs of the occupant of the seat.

Figure 10:
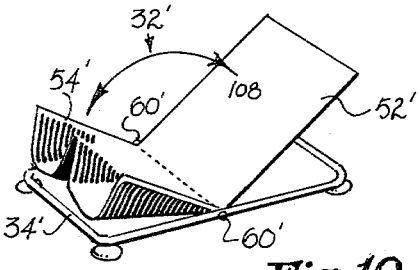
FIG. 10 is a simplified perspective drawing of the chair of the present invention in a first alternate embodiment.

Additionally, the chair itself can be constructed in various forms. In the preferred embodiment of FIG. 4 as hereinbefore described, the seat portion 50 has the upper portion 52 and bottom portion 54 thereof move in operable combination between the various positions shown in FIG. 3. By contrast, as shown in FIG. 10, seat 32′ could have the bottom portion 54′ firmly attached to the rectangular base 34' with only the upper portion 52' pivotable about pivot points 60' as shown by the arrow 108. Alternately, the bottom portion 54' could pivot at points 60'.

Figure 11:
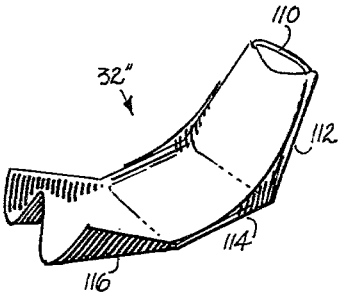
FIG. 11 is a simplified perspective drawing of the chair of the present invention in a second embodiment.
Figure 12:
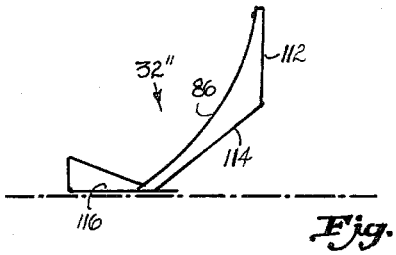
FIG. 12 is a simplified side view of the chair of FIG. 11 in its sitting up position.
Figure 13:
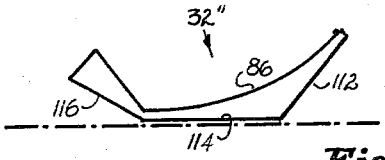
FIG. 13 is a simplified side view of the chair of FIG. 11 in its reclining position.

Likewise, another alternate (but unfoldable) embodiment 32 is shown with reference to FIGS. 11, 12, and 13. In this embodiment, the rectangular base 34 is omitted and a unitary frame 110 of rigid construction is provided. Unitary frame 110 comprises an upper portion 112, a middle portion 114, and a bottom portion 116. When the unitary frame 110 is resting on the bottom portion as shown in FIG. 12, the chair 32" is in a seated position. By tilting the unitary frame 110 backwards such that the weight is supported by the middle portion 114 as shown in FIGS. 11 and 13, the chair 32" is placed in a reclining position.

Figure 14:
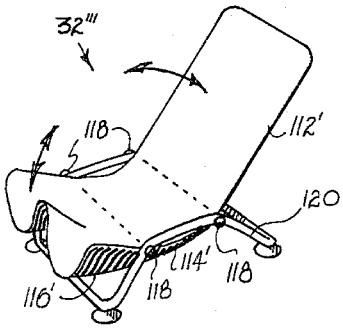
FIG. 14 is a simplified perspective drawing of the chair of the present invention in a third alternate embodiment.

Yet another variation is shown in the chair 32''' of FIG. 14. In this variation, the chair 32''' comprises an upper portion 112', a middle portion 114' and a bottom portion 116' interconnected by pivot points 118 as shown. The middle portion 114' is supported on legs 120. The pivot points 118 include releasable locking means of any of a number well-known to those skilled in the art. By releasing the locking means of pivot 118, the upper portion 112' and the bottom portion 116' can be rotated about pivot points 118 to achieve the desired positioning of the chair 32'''.

Figure 15:
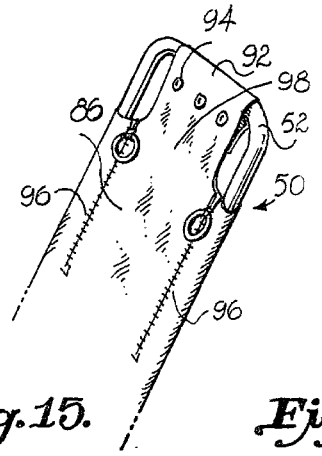
FIGS. 15–21 show various alternate methods for constructing the back of the chair of the present invention to achieve the objectives thereof.

Likewise, the construction of the back of the chair to provide the hair-washing features can be accomplished in a number of manners. The use of zippers 96 in the fabric sling portion 86 adjacent the top of upper portion 52 as shown in FIG. 15 and previously described is the preferred embodiment.

Figure 16:
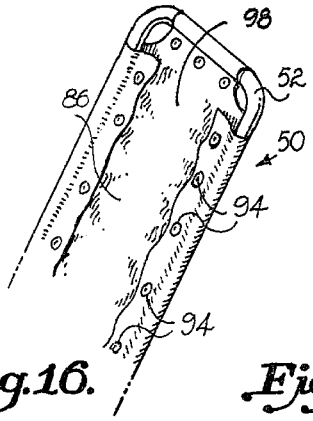

In FIG. 16, a variation is shown wherein the zippers 96 are replaced by additional snaps 94 which can be unsnapped to release flap 98.

Figure 17:
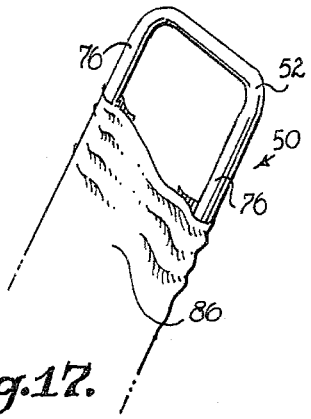

In FIG. 17, the fabric sling portion 86 along side pieces 76 is in the form of a loose cylinder such that when loop 92 is released, the fabric of fabric sling portion 86 can be slid down over side pieces 76.

Figure 18:
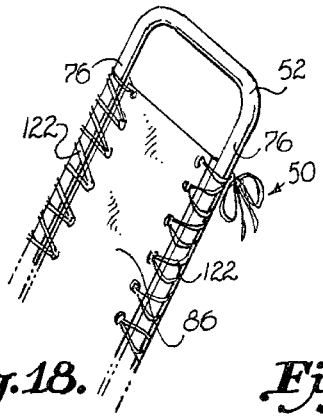

In the embodiment of FIG. 18, fabric sling portion 86 is tied to the side pieces with releasable ties 122.

Figure 19:
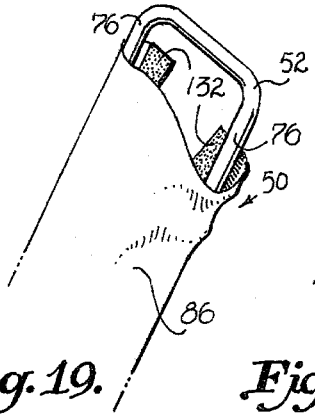

In the embodiment of FIG. 19, the fabric sling portion 86 is releasably connected to the side pieces 76 with material sold under the tradename of Velcro whereby it can be connected to the side pieces 76 by pressure and released therefrom by a pulling force exceeding a threshold amount.

Figure 20:
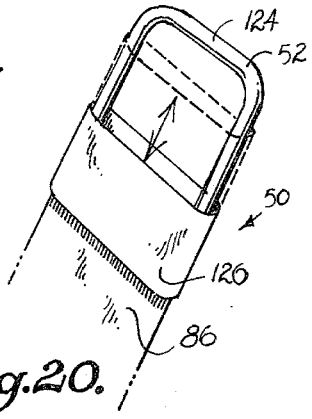

As shown in FIG. 20, the upper portion 52 can be comprised of two telescoping sections 124 and 126 whereby if section 126 is raised or lowered with respect to section 124, the positioning of fabric sling portion 86 carried by section 126 is raised or lowered.

Figure 21:
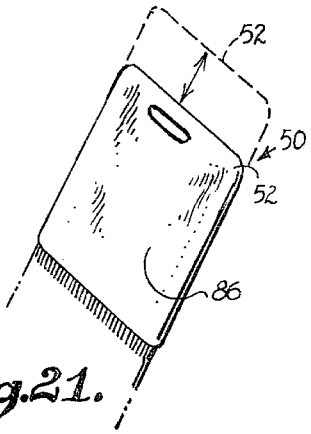

In a similar embodiment, as shown in FIG. 21, the whole upper portion 52 is made to slide up and down between the positions shown.

Figure 22:
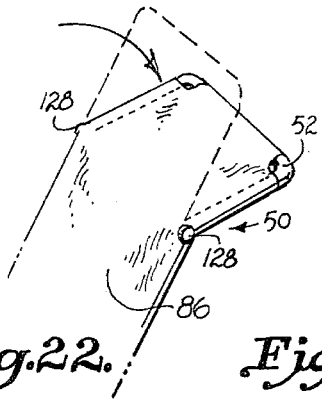

A similar effect can be accomplished as shown in FIG. 22 by including pivots 128 in upper portion 52 whereby the top of upper portion 52 can be rotated to expose the head of the occupant for washing.

Figure 23:
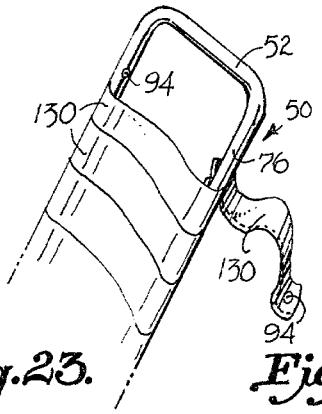

Finally, in FIG. 23, the fabric sling portion 86 in the region of upper portion 52 can comprise a plurality of individual horizontal strips 130 attached to upper portion 52 as by snaps 94 or the Velcro material previously described.

Thus, it will be appreciated that the chair of the present invention can be constructed in a number of manners to accomplish the stated objectives by incorporating the novel features thereof, such as the U-shaped portions to hold and separate the legs and the releasable portion adjacent the head to expose the head and hair for washing.

While the chair of the present invention in its various embodiments as hereinbefore described is primarily directed to providing a chair for the bathing of handicapped individuals in general and children in particular, it should be recognized that the novel basic structure disclosed therein has considerable value in other uses.

For example, the chair could be molded in its entirety of plastic or the like employing a leg lifting and separating portion as shown in FIG. 8 to obtain the benefits thereof. Such a molded construction with a suitable hole through the seat portion and an appropriate clipping or attaching means incorporated therein would also provide a superior so-called "potty" seat for allowing handicapped individuals subject to contorting of the limbs, as described earlier, to use a normal toilet with their legs supported and separated by the unique structure of the seat of the present invention.

Wherefore, having thus described our invention, we claim:

1. An orthopedic chair particularly adapted for bathing handicapped persons comprising:

(a) a frame assembly having a pair of spaced side members, a bottom member connected between said side members on one of the ends of said side members, and a top member connected in parallel to said bottom member between said side members on the ends thereof opposite said bottom member, said frame assembly further including support means for supporting said frame assembly and for maintaining the top and bottom members horizontal with said top member above said bottom member when said frame assembly is placed on a substantially horizontal surface, said bottom member further being in the shape of two upward facing U-shaped sections; and, (b) a body portion of flexible sheeting connected to said frame assembly between said bottom member and said side members to a point close adjacent the top member to form a sling chair wherein the person can sit supported from a point about the knees up to and including the person's head, said body portion including means for selectively releasing only a portion of said connection of said body portion between said side members adjacent the top portion sufficient to not support the person's head and provide access for washing the back of the person's head and hair while continuing to support the remainder of the person's torso, said releasing means comprising a pair of zippers extending from an edge of said body portion adjacent said top member toward said bottom member and disposed to have respective ones of said zippers on opposite sides of the head of the person in the seat, said body portion further being attached to said bottom member so as to form a U-shaped sling in each of said U-shaped sections whereby the legs of the person when placed in respective ones of said slings are supported and separated.

2. An orthopedic chair comprising:

(a) a seat member having a seat portion for supporting the buttocks of an individual sitting in the chair and an adductor portion comprising two U-shaped segments for supporting and separating the upper legs of an individual sitting in the chair;

(b) a back member attached to said seat member for supporting the back and head of an individual sitting in the chair, said back member including a releasable portion adjacent the head of an individual sitting in the chair for exposing the back of the individual's head and hair for washing, said releasable portion being connected to the remainder of the back by zippers whereby said portion is released by opening said zippers and connected by closing said zippers; and, (c) support means attached to said seat and back members for moveably supporting said seat and back members in a sitting position wherein said back member is at about 60° to the horizontal and a reclining position wherein said back member is at about 30° to the horizontal.

* * * * *